US007261028B2

(12) United States Patent
Devries et al.

(10) Patent No.: US 7,261,028 B2
(45) Date of Patent: Aug. 28, 2007

(54) ORDNANCE SYSTEM WITH COMMON BUS, METHOD OF OPERATION AND AEROSPACE VEHICLE INCLUDING SAME

(75) Inventors: Derek Devries, Farr West, UT (US); Bill Slade, Newark, DE (US); Bonnie Uresk, Brigham City, UT (US); Scott R. Jamison, River Heights, UT (US); Robert A. Rauscher, Moorestown, NJ (US)

(73) Assignee: Alliant Techsystems, Inc., Edina, MN (US)

( * ) Notice: Subject to any disclaimer, the term of this patent is extended or adjusted under 35 U.S.C. 154(b) by 0 days.

(21) Appl. No.: 10/744,930

(22) Filed: Dec. 22, 2003

(65) Prior Publication Data

US 2005/0150998 A1 Jul. 14, 2005

(51) Int. Cl.
*B64D 1/04* (2006.01)

(52) U.S. Cl. ..... 89/1.1; 102/206; 102/215; 102/200; 73/35.14; 73/865.9; 701/34

(58) Field of Classification Search ..... 102/301, 102/206, 200, 215; 73/35.14, 865.9, 35.16; 701/29, 34, 35; 89/1.1
See application file for complete search history.

(56) References Cited

U.S. PATENT DOCUMENTS 6,584,907 B2 * 7/2003 Boucher et al. ..... 102/217
2003/0056678 A1 * 3/2003 Griggs et al. ..... 102/202.1
2004/0231545 A1 * 11/2004 Lloyd ..... 102/202.5

FOREIGN PATENT DOCUMENTS

| | | | |
|---|---|---|---|
| EP | 1 186 852 | A1 | 3/2002 |
| WO | WO 01/071272 | A2 | 9/2001 |
| WO | WO 01/071272 | A3 | 9/2001 |

OTHER PUBLICATIONS

Search Report of Oct. 19, 2005, performed by the EPO for the French Patent Office.

* cited by examiner

*Primary Examiner*—J. Woodrow Eldred
(74) *Attorney, Agent, or Firm*—TraskBritt

(57) ABSTRACT

An ordnance system and method for controlling an ordnance system is provided. The system and method utilizes an addressable common, or shared, bus configured to transmit and receive data thereon. The addressable bus has further coupled thereto an ordnance controller including a control process and a telemetry process configured to control the addressable bus. The ordnance system further includes at least one initiator coupled to the addressable bus and responsive to the control process and at least one telemetry sensor coupled to the addressable bus and configured to interact with the telemetry process. The method provides control for the ordnance system by receiving telemetry data from a telemetry sensor over an addressable bus with an ordnance being further controlled by an ordnance controller over the addressable bus.

27 Claims, 4 Drawing Sheets

ORDNANCE SYSTEM WITH COMMON BUS, METHOD OF OPERATION AND AEROSPACE VEHICLE INCLUDING SAME

The U.S. Government has a paid-up license in this invention and the right in limited circumstances to require the patent owner to license others on reasonable terms as provided for by the terms of Contract No. NRO-000-01-C-4372.

BACKGROUND OF THE INVENTION

Field of the Invention

The present invention pertains generally to a communication structure on a launchable vehicle. More specifically, the present invention relates to an integrated ordnance system for various subsystems within a launchable vehicle.

State of the Art

Launchable vehicles utilize various onboard systems for performing a variety of independent functions. For example, a vehicle telemetry system provides telemetry data for control of the vehicle during flight. Various components of the telemetry system are distributed about the length of the vehicle and include control surfaces (e.g., fins or deflectors) at the tail of the vehicle as well as controller components located at the nose of the vehicle. To provide interaction with the various componentry, dedicated conductors are routed along the length of the vehicle creating additional vehicle weight and mechanical congestion through communication conduits or "raceways." Additional vehicle systems may further include systems such as an ordnance system used, for example, to initiate solid rocket motors, activate explosive charges for separating spent booster stages or activate pressure-equalizing atmospheric vents. Such systems also require dedicated conductors routed along the length of the vehicle and through raceways between the explosive charge and the ordnance controller which is generally located near the nose of the vehicle. This added dedicated cabling also contributes to cabling mass and congestion.

Furthermore, once vehicle system designs are completed, any modifications to the initial design such as incorporation of additional control elements, sensors, ordnance elements, upgrades or system augmentations or the like become impractical because of the "ripple" effects inherent in cabling redesign, mass management of additional cabling weights, redesign of cabling conduits and raceways, requalification of previously approved and verified designs and other impracticalities of system redesign.

Additionally, static status monitoring of a prelaunch vehicle for health and overall operational capability requires an additional system that, if implemented as an independent system, further burdens the vehicle with additional mass and cabling requirements. Therefore, it would be desirable to provide an integrated and expandable solution to the shortcomings in the prior art.

BRIEF SUMMARY OF THE INVENTION

The present invention comprises an ordnance system with a common bus. In one embodiment of the present invention, an ordnance system includes an addressable bus configured to receive and transmit data thereon. The addressable bus has further coupled thereto an ordnance controller including a control process and a telemetry process configured to control the addressable bus. The ordnance system further includes at least one initiator coupled to the addressable bus and responsive to the control process and at least one telemetry sensor coupled to the addressable bus and configured to interact with the telemetry process.

In another embodiment of the present invention, an ordnance system includes a telemetry system configured to receive telemetry data over an addressable bus and an ordnance control system configured to control an ordnance over the addressable bus. In a further embodiment of the present invention, a method is provided for controlling an ordnance system. Telemetry data is received from a telemetry sensor over an addressable bus and an ordnance is further controlled by an ordnance controller over the addressable bus.

In yet another embodiment of the present invention, an airframe has an addressable bus configured to transmit and receive data thereon with an ordnance controller configured to control the addressable bus with the ordnance controller including a control process and a telemetry process. The airframe further includes at least one initiator coupled to the addressable bus and responsive to the control process and at least one telemetry sensor coupled to the addressable bus and configured to interact with the telemetry process.

In yet a further embodiment of the present invention, a real-time health management system for monitoring an ordnance system includes an addressable bus over which a health monitoring process for monitoring a health status of at least one initiator and at least one telemetry sensor interacts with and includes at least one health monitoring sensor coupled to the addressable bus and configured to interact with the health monitoring process to determine the health status.

Additional features and advantages of the invention will be set forth in the description which follows, and in part will be apparent to those of ordinary skill in the art from the description, or may be learned by practice of the invention. The features and advantages of the invention may be realized and obtained by means of the instrumentalities and combinations pointed out in the appended claims.

BRIEF DESCRIPTION OF THE SEVERAL VIEWS OF THE DRAWINGS

The accompanying drawings, which are incorporated in and constitute a part of the specification, illustrate what are currently considered to be best modes for carrying out the invention.

DETAILED DESCRIPTION OF THE INVENTION

Figure 1:
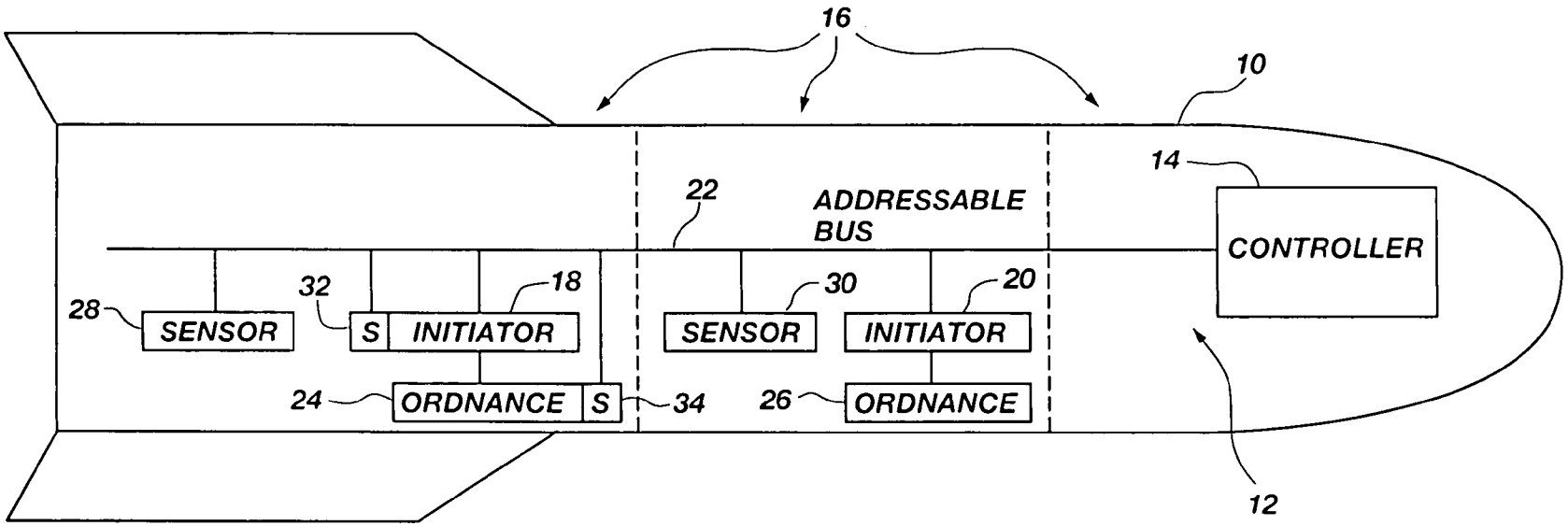
FIG. 1 is a block diagram of an airframe configured to include an ordnance system, in accordance with an exemplary embodiment of the present invention.

Reference will now be made in detail to the exemplary apparatus embodiments and methods of the present invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section.

An ordnance system in accordance with various embodiments of the present invention may be integrated or utilized with various types of airframes including rockets, satellites, missiles, launch vehicles, or other such devices where ordnances are utilized to initiate various state changes. Such ordnances include but are not limited to ignition devices, exploding bolts, actuators, gas generators, separation devices, pressure equalization and ventilation devices, individually and collectively referred to hereinafter as "ordnances."

While an ordnance provides the actual explosive or pyrotechnic action, such devices are typically coupled to electrically operated or controlled initiators which respond to specific electrical signals and initiate the designed operation of the ordnance coupled thereto. The initiation signals directed to a specific initiator originate or are provided by an electronic controller which orchestrates the coordination of the activation of one or more initiators coupled thereto. In FIG. 1, an airframe 10 is illustrated as including an ordnance system 12 including various components herein described. As illustrated, an ordnance system 12 may be deployed across multiple stages 16 of a particular airframe 10. Furthermore, ordnance system 12 may include an ordnance controller 14 and one or more initiators 18, 20 coupled thereto via an addressable bus 22. Ordnance system 12 further includes one or more respective ordnances 24, 26 responsive to one or more respective, associated initiators 18, 20. Ordnance system 12 may further include one or more sensors 28, 30 further coupled to ordnance controller 14 via addressable bus 22. Sensors 28, 30 may include telemetry sensors or other sensors configured to provide information of significance to ordnance system 12.

FIG. 1 further illustrates portions of a health management system as described below which may include sensors illustrated as health sensors 32, 34 which are accessible and coupled to ordnance controller 14 via addressable bus 22. By way of example and not limitation, health sensor 32 is configured to provide sensory information to ordnance controller 14 regarding the readiness or capability of initiator 18 while health sensor 34, also coupled to ordnance controller 14 via addressable bus 22, is configured to provide a health and reliability status of ordnance 24. Status information finds application to the service life of ordnance 24 as well as enabling improved safety and reliability through monitoring of potential failure modes of ordnance 24 as well as other structures or support functions which find utility to the activation or utilization of ordnance 24.

Figure 2:
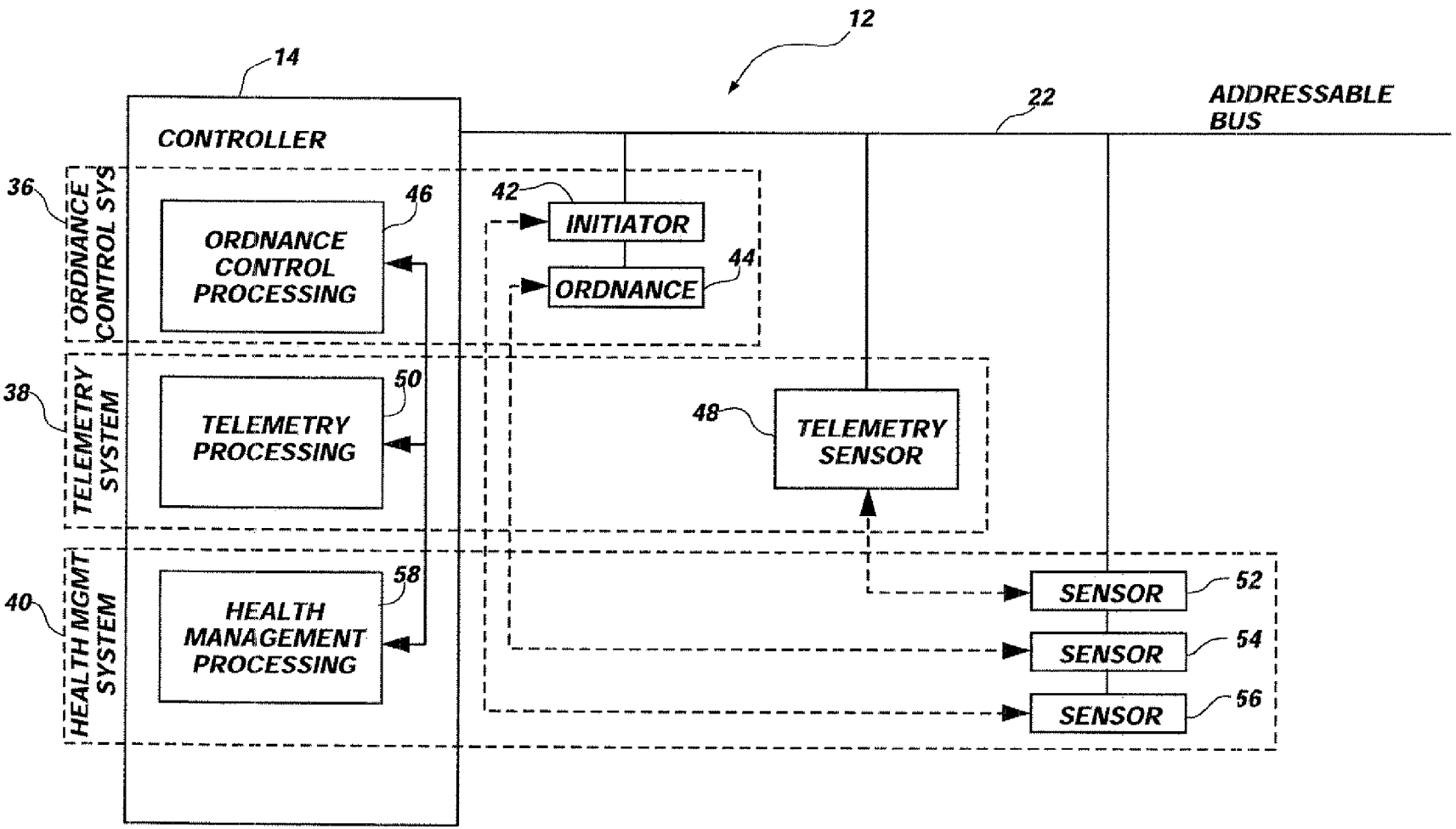
FIG. 2 is a block diagram of an ordnance system, in accordance with an exemplary embodiment of the present invention.

FIG. 2 illustrates an ordnance system, in accordance with an embodiment of the present invention. While ordnance system 12 in FIG. 1 is illustrated as being comprised of various components, FIG. 2 illustrates ordnance system 12 as being comprised of various systems. As illustrated in FIG. 2, ordnance system 12 is comprised of an ordnance control system 36 which generally controls the initiation and sequencing of one or more initiators via addressable bus 22, one of which is illustrated as initiator 42 further coupled to an ordnance 44. The sequencing and activation of initiator 42 is controlled by ordnance control processing 46 within ordnance controller 14.

Ordnance system 12 may further include a telemetry system 38 for monitoring and retrieving sensory data from one or more telemetry sensors 48 which is accessible via the addressable bus 22. Telemetry sensor data is managed and requested via telemetry processing 50 within ordnance controller 14.

Ordnance system 12 further includes a health management system 40 which includes one or more sensors 52–56 which are under the control of health management processing 58 within ordnance controller 14. Sensors 52–56 may be used to monitor one or more health statuses of various componentry within ordnance system 12 including, but not limited to, the status or operational readiness of initiator 42 (via sensor 56), the functionality and reliability of ordnance 44 (via sensor 54) as well as any other physical surroundings or the environment about ordnance 44. Additionally, health management system 40 may further monitor through a sensor, such as sensor 52, various functional aspects of telemetry sensor 48.

Various sensors may be employed for monitoring subsystems and components of the system. By way of example and not limitation, exemplary sensors may include fiber optic sensors distributed about the bore of a rocket motor for monitoring and measuring grain deformation and bore choking of the motor's bore and side-load fiber optic sensors for monitoring internal motor pressure and bond line integrity. Additional fiber optic sensors may include end-load pressure sensors for monitoring joint and nozzle pressures and fiber optic temperature sensors responsive to joint temperature and insulation temperatures. Other technology sensors may include ultrasonic sensors for measuring and monitoring case and nozzle material integrity and eddy current sensors for measuring and monitoring material damage to, for example, nozzles, cases, and propellant.

As illustrated, the various systems, ordnance control system 36, telemetry system 38 and health management system 40, utilize a common bus, addressable bus 22, for facilitating and establishing communications between the various systems and the corresponding initiators and sensors. Such a configuration is advantageous as each of the initiators and sensors are coupled via a common addressable bus 22 as controlled by ordnance controller 14. In accordance with an embodiment of the present invention, each of the initiators and sensors are configured to be responsive to a unique address as exchanged across addressable bus 22. As such, a given initiator is programmed only to respond to a specific address code uniquely assigned to that initiator or group of initiators.

Figure 3:
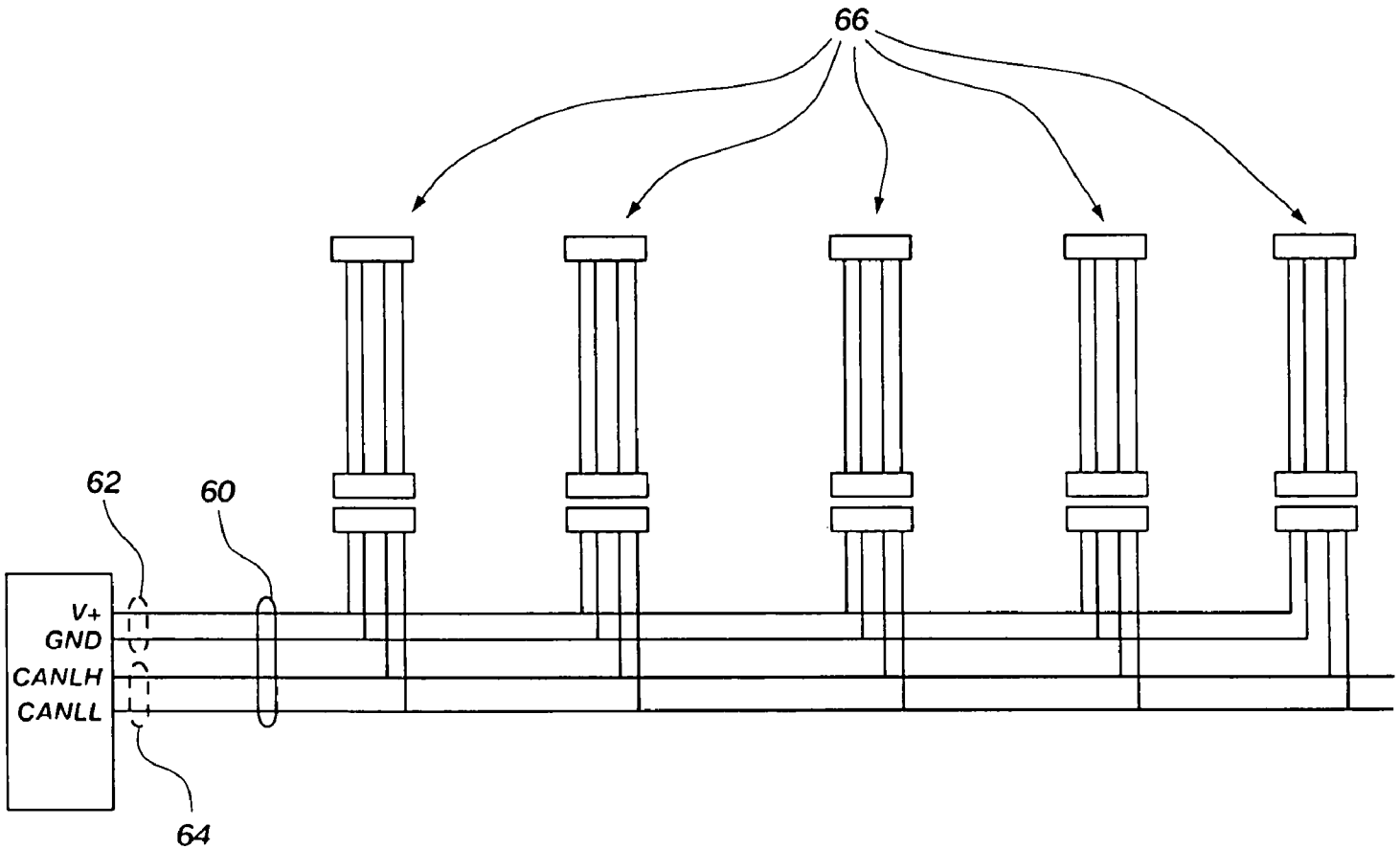
FIG. 3 is a schematic diagram of a common communication bus, in accordance with an exemplary embodiment of the present invention.

FIG. 3 illustrates one specific embodiment of a common bus, in accordance with an exemplary embodiment of the present invention. A common bus structure is illustrated as addressable bus 60 which is illustrated to include a four-wire configuration. By way of example and not limitation, addressable bus 60 includes a pair of conductors for providing operational power illustrated as power signals 62 comprised of a power line and a ground line. Bus 60 further comprises a pair of shared bus signals illustrated as shared bus signals 64. As illustrated, because of the bus architecture of the present invention, various sensors and initiators may be coupled to the bus while incurring negligible additional mass and virtually no additional routing congestion through conductive raceways or conduits as previously described. FIG. 3 illustrates a modular coupling of sensors or initiators through one or more modular interconnects 66.

One exemplary implementation of a serial bus includes a controller area network (CAN) protocol such as the ISO DIS 16845, ISO DIS 11898. International CAN Standards available from International Organization for Standardization (ISO) and the American National Standards Institute (ANSI) of Washington D.C., United States of America. The CAN protocol is a serial communication protocol for communicating between various electronic devices or nodes. In accordance with the CAN protocol, multiple different electronic devices or nodes may be coupled to a single serial bus such that messages and data may be sent from one electronic device or node to another. The CAN protocol is a message-based protocol wherein CAN frames are placed on a common CAN bus, illustrated in FIG. 3 as shared bus signals 64. The CAN bus may be a single wire or may be a differentially driven pair of wires with each node on the common CAN bus receiving each CAN frame presented on the CAN bus and filtering out those CAN frames which are not specifically addressed to a particular node.

Figure 4:
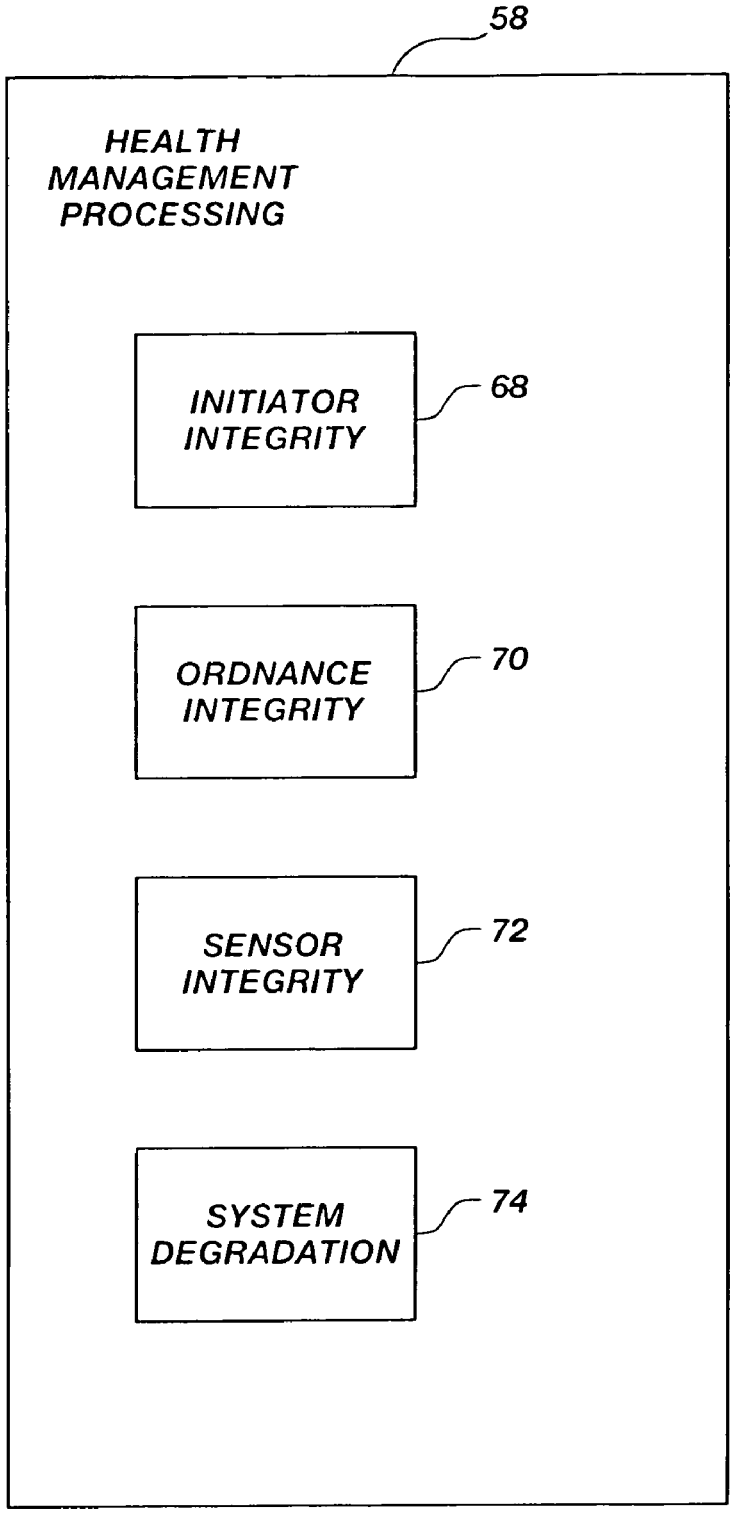
FIG. 4 is a block diagram of health management processing, in accordance with an exemplary embodiment of the present invention.

FIG. 4 illustrates a health management processing module, in accordance with an exemplary embodiment of the present invention. By way of example, and not limitation, health management processing 58 may include one or more processing modules for interfacing with corresponding health sensors coupled to various components throughout the ordnance system. By way of example and not limitation, health management processing 58 may include an initiator integrity module 68 which interfaces with the sensor 56 (FIG. 2) for determining one or more health conditions of an initiator 42 (FIG. 2). The health conditions of an initiator may be of interest at various times during the lifespan of an airframe integrating one or more embodiments of the ordnance system of the present invention. For example, the health of an initiator may be examined prior to scheduled activation of the initiator. Additionally, the health of the initiator may be of concern prior to launch or deployment of the airframe embodying the ordnance system of the present invention. Furthermore, the reliability of an initiator may be periodically monitored to determine the readiness for deployment of a stored or offline airframe containing an ordnance system.

Health management processing 58 may further include an ordnance integrity module 70 which interfaces with the sensor 54 (FIG. 2) for determining one or more health conditions of an ordnance 44 (FIG. 2). The health conditions of an ordnance may be of interest at various times during the lifespan of an airframe integrating one or more embodiments of the ordnance system of the present invention. For example, the health of an ordnance may be examined prior to scheduled initiation of the ordnance. Additionally, the health of the ordnance may be of concern prior to launch or deployment of the airframe embodying the ordnance system of the present invention. Furthermore, the reliability of an ordnance may be periodically monitored to determine the readiness for deployment of an airframe containing the ordnance system. Safety improvements, such as fewer ordnance components, continuous health monitoring and reduced operational handling relating to off-line testing, result from the health management processing of the various embodiments of the present invention.

Additionally, health management processing 58 may further include a sensor integrity module 72 which interfaces with sensor 52 (FIG. 2) for determining one or more health conditions of another sensor, an example of which is a telemetry sensor 48. The health conditions of a sensor may be of interest at various times during the lifespan of an airframe integrating one or more embodiments of the ordnance system of the present invention. For example, the health of a sensor may be examined prior to a scheduled query of that sensor. Additionally, the health of the sensor may be of concern prior to launch or deployment of the airframe embodying the ordnance system of the present invention. Furthermore, the reliability of a sensor may be periodically monitored to determine the readiness for deployment of an airframe containing an ordnance system.

The health management processing 58 may further include a system degradation module 74 which monitors the overall status and variations within the airframe embodying the ordnance system of the present invention. The system degradation module 74 facilitates off-line system readiness and lifespan testing by tracking not only the variations to sensor data as described above, but also ordnance propellant degeneration and ordnance housing strains and stresses, among other parameters.

Advantages and benefits may be realized as a result of the practice of the various embodiments of the present invention including a reduction in cabling through the use of a shared or common bus architecture which utilizes a single physical bus along the length of the airframe rather than dedicated sensor and initiator cabling redundantly traversing from the position of the sensor or initiator to the generally distantly located controller. A reduction in redundant cabling along even a nominal length of an airframe is significant and the mass savings is even further magnified when enlarged or additional raceways for any redundant cabling is factored into a cost and mass reduction analysis. Furthermore, additional cabling and raceway mass also requires additional propellant for launch and flight of the airframe in order to fulfill the designed objective of the airframe. Enhanced reliability is also realized through the practice of the various embodiments of the present invention since the use of fewer components directly translates into fewer opportunities for the manifestation of failures. Additionally, design flexibility, system enhancement/upgrade/expansion opportunities become practical due of the mitigation of the impact of modifications to the overall airframe architecture.

Additional advantages and modifications will readily occur to those skilled in the art. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

What is claimed is:

1. An ordnance system, comprising:

an addressable bus configured to receive and transmit data thereon;

an ordnance controller coupled to and configured to control the addressable bus, the ordnance controller including a control process and a telemetry process;

at least one initiator coupled to the addressable bus and responsive to the control process;

at least one telemetry sensor coupled to the addressable bus and configured to interact with the telemetry process; and a health monitoring process configured to monitor degradation of the ordnance system by tracking variations of at least one of the at least one initiator and the at least one telemetry sensor over a lifespan of the at least one of the at least one initiator and the at least one telemetry sensor.

2. The ordnance system of claim 1, further comprising a health management system including at least one health monitoring sensor coupled to the addressable bus and configured to interact with the health monitoring process to determine the health status.

3. The ordnance system of claim 2, wherein the at least one health monitoring sensor is configured to detect a failure condition of one of the at least one initiator and at least one ordnance and the at least one telemetry sensor in the ordnance system.

4. The ordnance system of claim 3, wherein the health monitoring process is further configured to determine a health status of at least a part of the ordnance system when activation of one of the at least one initiator by the control process is not pending.

5. The ordnance system of claim 3, wherein the health monitoring process is configured to determine a health status of at least a part of the ordnance system when activation of one of the at least one initiator by the control process is pending.

6. The ordnance system of claim 1, wherein the ordnance system is configured for deployment on an airframe including one of an aircraft, a satellite and a rocket.

7. The ordnance system of claim 6, wherein the ordnance system is configured for deployment on the airframe including multiple stages.

8. The ordnance system of claim 1, wherein the ordnance controller is configured to control the addressable bus according to a controller area network (CAN) protocol.

9. The ordnance system of claim 1, further comprising an ordnance coupled and configured to be responsive to one of the at least one initiator.

10. An ordnance system, comprising:

an addressable bus;

a telemetry system configured to receive telemetry data over the addressable bus, the telemetry system including a telemetry process configured to retrieve telemetry data over the addressable bus, and at least one telemetry sensor configured to generate the telemetry data and transmit the telemetry data over the addressable bus to the telemetry process;

an ordnance control system configured to control an ordnance over the addressable bus, the ordnance control system including an ordnance control process configured to generate an ordnance initiation and at least one initiator responsive via the addressable bus to the ordnance initiation; and a health management system including a health monitoring process configured to monitor degradation of the ordnance system by tracking variations of at least one of the at least one initiator and the at least one telemetry sensor over a lifespan of the at least one of the at least one initiator and the at least one telemetry sensor.

11. The ordnance system of claim 10, further comprising an ordnance coupled and responsive to the at least one initiator.

12. The ordnance system of claim 11, further comprising a health management system including a health monitoring sensor coupled to the addressable bus and configured to interact with the health monitoring process to determine the health status.

13. The ordnance system of claim 12 wherein the health monitoring sensor is configured to detect a failure condition of one of the at least one initiator and at least one ordnance in the ordnance system.

14. The ordnance system of claim 12, wherein the health monitoring process is further configured to determine a health status of the ordnance system prior to initiation of the ordnance.

15. The ordnance system of claim 10, wherein the addressable bus is configured according to a controller area network (CAN) protocol.

16. The ordnance system of claim 12, wherein the health monitoring process includes a system degradation module configured to determine a degradation of at least one ordnance of the ordnance system.

17. A method for controlling an ordnance system, comprising:

receiving telemetry data from at least one telemetry sensor over an addressable bus;

controlling an ordnance via at least one initiator over the addressable bus; and monitoring degradation of the ordnance system by tracking variations of at least one of the at least one initiator and the at least one telemetry sensor over a lifespan of the at least one of the at least one initiator and the at least one telemetry sensor.

18. The method of claim 17, wherein controlling an ordnance comprises:

generating an ordnance initiation signal at a ordnance control process;

transmitting the ordnance initiation signal over the addressable bus; and responding to the ordnance initiation signal at the at least one initiator to activate an ordnance in response thereto.

19. The method of claim 17, wherein receiving telemetry data comprises:

generating telemetry data at the at least one telemetry sensor; and retrieving telemetry data at a telemetry process from the at least one telemetry sensor over the addressable bus.

20. The method of claim 17, wherein monitoring degradation further comprises:

requesting sensor data for a health monitoring process from a health monitoring sensor over the addressable bus; and transmitting the sensor data from the health monitoring sensor to the health monitoring process over the addressable bus.

21. An airframe, comprising:

an addressable bus configured to receive and transmit data thereon;

an ordnance controller coupled to and configured to control the addressable bus, the ordnance controller including a control process and a telemetry process;

at least one initiator coupled to the addressable bus and responsive to the control process;

at least one telemetry sensor coupled to the addressable bus and configured to interact with the telemetry process; and a health monitoring process configured to monitor degradation of the airframe by tracking variations of at least one of the at least one initiator and the at least one telemetry sensor over a lifespan of the at least one of the at least one initiator and the at least one telemetry sensor.

22. The airframe of claim 21, further comprising a health management system including at least one health monitoring sensor coupled to the addressable bus and configured to interact with the health monitoring process to determine the health status.

23. The airframe of claim 22, wherein the at least one health monitoring sensor is configured to detect a failure condition of one of the at least one initiator and at least one ordnance and the at least one telemetry sensor in the airframe.

24. A real-time health management system for monitoring an ordnance system, comprising:

an addressable bus;

a health monitoring process for monitoring degradation of the ordnance system by tracking variations of at least one of at least one initiator and at least one telemetry sensor over a lifespan of the at least one of the at least one initiator and the at least one telemetry sensor; and at least one health monitoring sensor coupled to the addressable bus and configured to interact with the health monitoring process to determine a health status of the ordnance system.

25. The real-time health management system of claim 24, wherein the at least one health monitoring sensor is configured to detect a failure condition of one of the at least one initiator and at least one ordnance and the at least one telemetry sensor in the ordnance system.

26. The real-time health management system of claim 25, wherein the health monitoring process is further configured to determine a health status of at least a part of the health management system when activation of one of the at least one initiator is not pending.

27. The real-time health management system of claim 25, wherein the health monitoring process is configured to determine a health status of at least a part of the ordnance system when activation of one of the at least one initiator is pending.

* * * * *